United States Patent [19]

Bosman

[11] Patent Number: 4,516,483

[45] Date of Patent: May 14, 1985

[54] AIR BLOWING DEVICE

[75] Inventor: Jakob Bosman, Eindhoven, Netherlands

[73] Assignee: U.S. Philips Corporation, New York, N.Y.

[21] Appl. No.: 477,107

[22] Filed: Mar. 21, 1983

[30] Foreign Application Priority Data

Apr. 2, 1982 [NL] Netherlands ..... 8201410

[51] Int. Cl.[3] ..... F24F 13/072

[52] U.S. Cl. ..... 98/40.14

[58] Field of Search ..... 98/40 R, 40 D, 40 N

[56] References Cited

U.S. PATENT DOCUMENTS

| | | | |
|---|---|---|---|
| 3,227,063 | 1/1966 | Lambert | 98/40 D |
| 3,266,408 | 8/1966 | Palmquist | 98/40 D |
| 3,654,471 | 4/1972 | Nilsson | 250/85 |
| 3,757,668 | 9/1973 | Dean, Jr. | 98/40 D |
| 3,974,755 | 8/1976 | Honmann | 98/40 D |

FOREIGN PATENT DOCUMENTS

| | | | |
|---|---|---|---|
| 2218794 | 10/1973 | Fed. Rep. of Germany | 98/40 D |
| 1203658 | 9/1970 | United Kingdom . | |

*Primary Examiner*—Harold Joyce

*Attorney, Agent, or Firm*—Rolf E. Schneider

[57] ABSTRACT

An air-discharge device for incorporation in a ceiling comprises an elongate housing of substantially rectangular cross section, such housing having two longitudinal vertical sides, two vertical ends, and a longitudinal upper horizontal side, the longitudinal lower horizontal side being open and substantially flush with the ceiling, each longitudinal vertical side being formed with an elongate lower edge. An air inlet is provided in the housing. Two longitudinal walls extend obliquely into the housing from the respective lower edges of the vertical sides, the inner edges of these two walls defining a longitudinal air passage slot therebetween. A plurality of air-deflecting L-shaped guide blades extends lengthwise along the housing between such two walls, the guide blades being alternately secured at one end of the vertical portion of the L to the respective two walls, each guide blade having the horizontal portion of its L lying in a plane including the elongate lower edges, the guide blades thereby forming with the respective two walls alternately directed air discharge outlets. As a result, the air discharged through such outlets flows substantially along the ceiling.

3 Claims, 3 Drawing Figures

AIR BLOWING DEVICE

Figure 1:
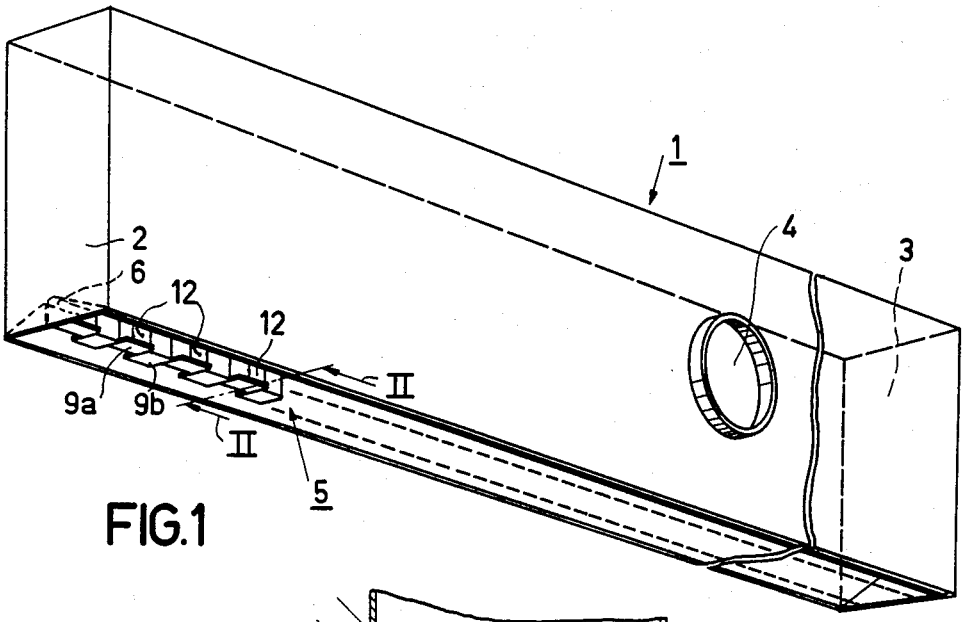

This invention relates to an air blowing or discharging device, for incorporation in a ceiling, comprising a thin-walled elongate housing of substantially rectangular cross-section which is provided with end partitions and an air inlet aperture, one face of the housing being provided with air outlet apertures. Such a device is known from British Pat. No. 1,203,658.

This type of device is generally used for the ventilation of a space, such as a room, an office or the like, by blowing air into the space. Satisfactory mixing of air emanating from the device with air already present in the space is the objective. Furthermore, satisfactory ventilation must be obtained without the creation of draughts in the space. This applies especially when cool air is blown into the space in order to compensate for the heat produced by illumination, machines, persons, etc.

The device described in the aforementioned British Patent comprises two relatively displaceable wall portions, which are each provided with air outlet apertures and can be arranged with respect to each other so that the air jets emanating from the apertures touch each other. In this device, the air is blown out in a substantially vertical direction. In this case, unsatisfactory mixing of air in the space with air originating from the air outlet apertures of the device results in order to avoid undesired draughts; especially in spaces having a comparatively low ceiling, the quantity of air that can be blown out is limited. The cooling capacity of the said device is then low.

The present invention has for its object to provide an air blowing device having a high cooling capacity, while a satisfactory mixing of the air emanating from the device with the air present in the space is obtained and annoying draughts are avoided.

According to the invention, the air blowing or discharge device is characterized in that two walls extend obliquely into the housing from the respective elongate edges of the one face to define a longitudinal air passage slot between their inner edges, and a series of air-deflecting guide blades extends along the housing between said two walls, said guide blades being alternately secured at one end to the respective two walls, the arrangement being such that the blades alternately deflect air, passing through the slot towards the respective elongate edges.

In the device according to the invention, the air is blown out so that an intimate mixing of (cool) air blown out and (comparatively hot) air in the space is obtained substantially only along the ceiling. As a result of the particular manner in which the air is blown out, the inducing surface of the air jets blown out (that is to say the contact surface between the air mass blown out and the air in the space) is comparatively large. Moreover, a quantity of air comparatively large per unit length can be discharged into the space without adversely affecting the comfort in the living zone of this space. The cooling capacity of the device according to the invention is therefore high. Another advantage of the device according to the invention is that it can be manufactured in a comparatively simple manner.

In an embodiment of the device according to the invention, the free ends of the respective guide blades lie in the plane including the elongate edges of the one face. The air jets are then blown out substantially parallel to the ceiling.

In given embodiments, the guide blades may be constructed in the form of curved plates. However, the guide blades are preferably L-shaped. A satisfactory guiding of the discharged air along the ceiling is then obtained, whilst the so-called "Coanda" effect is increased (see also U.S. Pat. No. 3,654,471).

In a practical embodiment of the device according to the invention, partitions which are substantially at right angles to the longitudinal extent of the housing are respectively arranged between adjacent guide blades. The air jets emanating from the outlet apertures then substantially do not influence each other.

Figure 2:
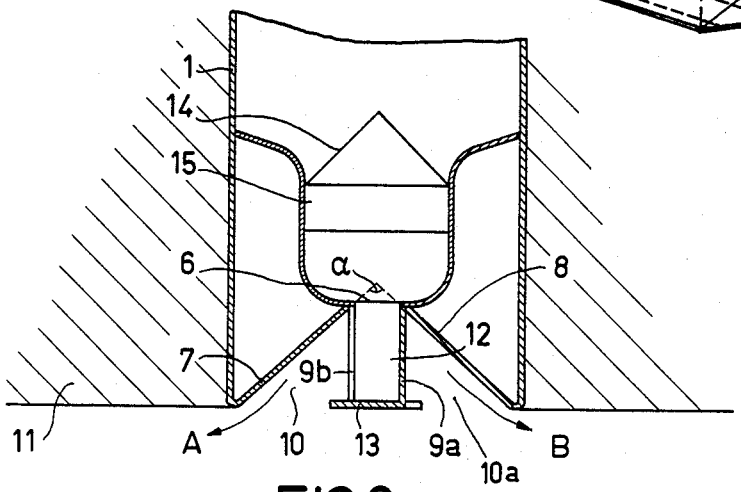
Figure 3:
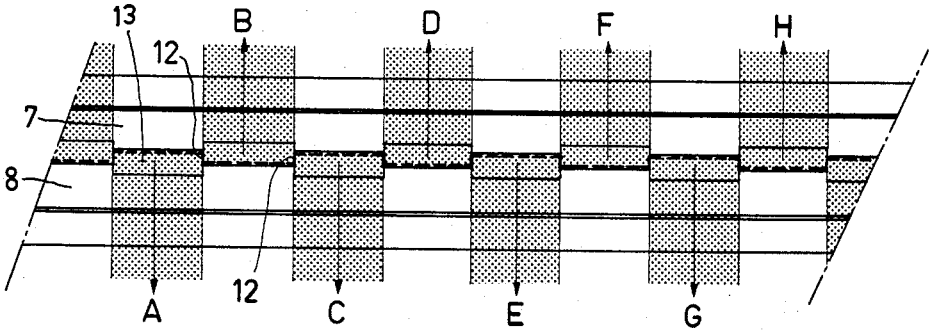

The invention will now be described more fully with reference to the accompanying drawing, in which:

FIG. 1 is a perspective diagrammatic view of an air blowing device according to the invention, FIG. 2 is a cross-section on an enlarged scale taken on the line II—II of the device shown in FIG. 1, and FIG. 3 is a plan view on a further enlarged scale of part of the longitudinal side facing the space to be ventilated.

The air blowing device shown in FIG. 1 comprises a thin-walled elongate metal housing 1 of substantially rectangular cross-section which is provided with end partitions 2 and 3, respectively. A wall of the housing is provided with an air inlet aperture 4 (for example, a connection for a hose). The housing is designed so as to be incorporated in and substantially flush with a ceiling, in which case only the longitudinal face 5 is visible to an observer. A longitudinal air passage slot 6 (see also FIG. 2) is defined by two wall portions 8 and 7 extending obliquely into the housing from the respective elongate edges of face 5. On these portions are secured L-shaped air deflecting guide blades *9a*, *9b* etc. overlapping at least in part the longitudinal slot 6 and alternately secured to the wall portions 8 and 7, respectively.

The guide blades *9a* and *9b* and the respective wall portions 7 and 8 form outlet apertures 10 and *10a* through which the air is blown out substantially along the ceiling as indicated by arrows A and B in FIG. 2. The ceiling is designated by 11. Transverse partitions 12 are arranged between the respective guide blades (see FIG. 1). The said oblique wall portions 7 and 8 enclose an angle $\alpha$ of approximately 110°. The inducing surface and the depth of penetration of the air jets are then optimum. The term "depth of penetration of an air jet" is to be understood to mean the distance of an outlet aperture from a point in the space at which the flow energy of the air jet is substantially zero.) In an embodiment, the length of the horizontal part 13 of the blade *9a* is approximately 115% of the width of the slot 6. A maximum quantity of air is then blown along the ceiling.

The housing of the device further accommodates a V-shaped perforated strip 14 extending parallel to the longitudinal extent of the housing in order to obtain a uniform air distribution over the length of the slot. Furthermore, the housing accommodates a plurality of blades 15 for guiding the air to the longitudinal slot 6.

The air jets are blown out alternately towards one of the two sides of the housing. The air jets are designated in FIG. 3 by A to H inclusive.

In a practical embodiment, the length of the housing is 165 cm. The diameter of the aperture 4 is 15 cm. The height of the housing is 24 cm and the width 6.6 cm. The width of the slot is approximately 0.85 cm; the distance between the several partitions 12 is 5.0 cm. The length of portion 13 is approximately 1.0 cm. The height of the L-shaped guide blades is approximately 1.3 cm.

What is claimed is:

1. An air-discharge device for incorporation in a ceiling, which comprises an elongate housing of substantially rectangular cross section, said housing having two longitudinal vertical sides, two vertical ends, a longitudinal upper horizontal side, and an open longitudinal lower horizontal side substantially flush with the ceiling, each longitudinal vertical side being formed with an elongate lower edge; an air inlet in said housing; two longitudinal walls extending obliquely into said housing from the respective lower edges of the longitudinal vertical sides, the inner edges of said two oblique walls defining a longitudinal air passage slot therebetween; a plurality of air-deflecting L-shaped guide blades extending lengthwise along said housing between said two oblique walls, said guide blades being alternately secured at one end of the vertical portion of the L to the respective two oblique walls, each guide blade having the horizontal portion of its L lying in a plane including the elongate lower edges, said guide blades thereby forming with the respective two oblique walls alternately directed air discharge outlets; and partitions arranged substantially transversely to the longitudinal extent of the housing between the respective adjacent guide blades, whereby the air discharged through said outlets flows substantially along the ceiling.

2. An air-discharge device according to claim 1, in which the horizontal portion of the L of each guide blade is approximately 115% of the width of the longitudinal slot.

3. An air-discharge device according to claim 1, in which the two oblique walls enclose an angle of approximately 110°.

* * * * *